US009950712B2

(12) United States Patent
Schulte et al.

(10) Patent No.: US 9,950,712 B2
(45) Date of Patent: Apr. 24, 2018

(54) SPREADING DEVICE FOR THE APPLICATION OF BRAKE SAND ON RAIL-MOUNTED VEHICLES

(71) Applicant: KLEIN Anlagenbau AG, Niederfischbach (DE)

(72) Inventors: Enno Schulte, Siegen (DE); Thomas Marks, Hanerau-Hademarschen (DE); Markus Jendrock, Niederfischbach (DE)

(73) Assignee: KLEIN Anlagenbau AG, Niederfischbach (DE)

( * ) Notice: Subject to any disclaimer, the term of this patent is extended or adjusted under 35 U.S.C. 154(b) by 315 days.

(21) Appl. No.: 14/961,140

(22) Filed: Dec. 7, 2015

(65) Prior Publication Data

US 2016/0159371 A1 Jun. 9, 2016

(30) Foreign Application Priority Data

Dec. 9, 2014 (DE) ..... 20 2014 105 936 U

(51) Int. Cl.
*B61C 15/10* (2006.01)

(52) U.S. Cl.
CPC ..... *B61C 15/102* (2013.01)

(58) Field of Classification Search
CPC ..... B61C 15/10; B61C 15/102; B61C 15/105; E01C 19/20; B24C 7/0046; B60B 39/086
USPC ..... 291/11.1
See application file for complete search history.

(56) References Cited

U.S. PATENT DOCUMENTS 682,150 A * 9/1901 Nichols ..... B61C 15/102 291/11.1
727,030 A * 5/1903 Tilghman ..... B24C 7/0046 291/11.1
834,108 A * 10/1906 Corey ..... B61C 15/102 291/11.1
1,404,904 A * 1/1922 Spencer ..... B61C 15/102 291/3
2,725,247 A * 11/1955 Saari ..... B61C 15/102 291/11.2
3,210,109 A 10/1965 Soler
4,325,573 A * 4/1982 Hefter ..... B60B 39/086 222/630

(Continued)

FOREIGN PATENT DOCUMENTS

DE 403433 C 9/1924
DE 8328423 U1 4/1984

(Continued)

OTHER PUBLICATIONS

Austrian Search Report for AT Patent Application GM 431/2014 dated Oct. 30, 2015.

*Primary Examiner* — Zachary L Kuhfuss
(74) *Attorney, Agent, or Firm* — Bachman & LaPointe, PC

(57) ABSTRACT

A spreading device for a pneumatic application of brake sand on rail-mounted vehicles, comprising an air source and a sand container as storage container for the brake sand or the spreading material, an outlet at the lower end of the sand container, a connecting pipe to a mixing container provided for air-charged swirling of the spreading material to form a sand stairway and a dispensing device disposed on the mixing container for the specific dispensing of the spreading material onto the rails in front of the wheels.

7 Claims, 1 Drawing Sheet

(56) References Cited

U.S. PATENT DOCUMENTS

| | | | |
|---|---|---|---|
| 2004/0160064 | A1 | 8/2004 | Kish et al. |

FOREIGN PATENT DOCUMENTS

| | | | |
|---|---|---|---|
| DE | 4122032 | A1 | 8/1992 |
| DE | 4114515 | A1 | 11/1992 |
| DE | 29713382 | U1 | 11/1998 |
| DE | 202014004632 | U1 | 8/2014 |

* cited by examiner

SPREADING DEVICE FOR THE APPLICATION OF BRAKE SAND ON RAIL-MOUNTED VEHICLES

BACKGROUND OF THE INVENTION

The invention relates to a spreading device for a pneumatic application of brake sand on rail-mounted vehicles, comprising an air source and a sand container as storage container for the brake sand or the spreading material, an outlet at the lower end of the sand container, a connecting pipe to a mixing container provided for air-charged swirling of the spreading material to form a sand stairway and a dispensing device disposed on the mixing container for the specific dispensing of the spreading material onto the rails in front of the wheels.

Spreading devices have been known for more than 100 years and in rail-mounted vehicles provide for an improvement in the traction and braking properties or prevent spinning or sliding of the wheels by compressed-air assisted application of sand onto the rails in front of the wheels.

The spreading material used is usually coarse natural quartz sand whose grain size distribution is designed for the mechanical requirements for increasing friction and for a reproducibly the same spreading quantity per unit time in the case of pneumatic application. However, ceramic sands or other free-flowing mineral particles in suitable grain size distribution and spreading quantity in each case can also be used. The proposed spreading device is advantageously suitable for all sand-like or free-flowing types of spreading materials.

Among the known spreading systems, various pneumatic spreading systems have been developed over time which differ in functional principle or mode of operation according to the available air pressure range.

For example, rail vehicles of the main-line railways are usually equipped with an on-board compressed air network which can provide compressed air at 3 to 10 bar for spreading devices. However, the generation and supply of compressed air in this magnitude is relatively expensive and this should usually be used sparingly for spreading devices. For this reason, spreading devices with available high compressed air potential preferably operate according to the ejector pump principle in order to use the impulse effect of a high-pressure free jet effectively and as efficiently as possible. A spreading device which, for example, operates according to the ejector pump principle has been disclosed with the utility model specification DE 20 2014 004 632 U1.

Known spreading devices of a different type produce a defined excess air pressure in the sand container and convey by means of the conveying flow produced inter alia by pressure equalization, an air-sand mixture usually via a so-called sand stairway, through a corresponding application device onto the rail in front of the wheels. Inter alia for cost reasons, such systems operate with a lower air pressure, for example, up to a maximum of 3 bar.

A sand spreading device of the aforesaid type with excess air pressure in the sand container has become known, for example, from the Unexamined Laid-Open Patent Application DE 41 14 515 A1 which is intended to assist the effect of the spreading sand conveying flow with a compressed air jet nozzle directed towards the inlet of the sand staircase. On account of the relatively long flow path of the air through the sand, where the sand can be additionally held up as a result of the acute-angled deflections, the resulting energy losses must be compensated by higher pre-set air pressure.

A sand spreading device of the aforesaid type with excess air pressure in the sand container has also become known from the utility model specification DE 83 28 423 U1 in which the compressed air source in the form of a compressor operated with 24 Volts of direct current is disposed inside the sand container. In this case, this sand container is connected via a gently ascending riser pipe to the perpendicularly downwardly directed downpipe which in turn is connected via a sanding hose to the spreading pipe in the region of the rail vehicle. In a sealed housing, the compressor is disposed on or on the sand container, the pressure hose of which is guided into the sand container and ends at a distance from the riser pipe, where the compressed air flowing out of the pressure hose presses the sand into and through the riser pipe whereupon the sand is dispensed via the downpipe. The relatively small cross-sectional area of the riser pipe is intended to prevent unintentional sanding as a result of sand liquefaction due to vehicle vibrations but can also have the disadvantageous effect that the sand in the riser pipe can compact and hold up.

A pneumatic sand spreading device which is to be operated with air in the lower-pressure range of 0.5 bar has become known from the Unexamined Laid-Open Patent Application DE 41 22 032 A1. In this case, a metering device flange-mounted to the sand container has a pot-shaped metering container. An outlet pipe projects into the metering container through its base, the upper end thereof projects below a fixed bell at a distance from the inner bell base. Located at a distance from the base of the metering container and underneath the bell is an air-permeable sintered metal plate through which compressed air can be blown into the sand container and under the bell. Located approximately at the highest point of the sand container is an elbow with downwardly pointing opening and an exhaust pipe which in turn is connected via an adjustable throttle to the outlet pipe. The blown-in air flow is therefore divided. Some of the air flows through the sand in the sand container and through elbow, exhaust pipe, throttle and outlet pipe into the open. The other part of the air flow under the bell, is intended to mobilize the sand and discharge it through the outlet pipe into the open or onto the rail. In this case, the throttle is intended to independently control the respective distribution of the quantitative fractions of the air flow. A disadvantage with this device is that depending on the filling height in the sand container the sand can compact and hold up under the bell due to its own weight. Another disadvantage is that the amount of air which is intended to flow through elbow, exhaust pipe, throttle and through the sand in the sand container is also dependent on the fill level of the sand in the sand container.

In addition, in known spreading devices the disadvantage can occur that even coarse spreading sand can at least partially lose its pourability due to wetting with moisture and in the case of corresponding holding up or compaction as a result of its own weight or vibrations, can no longer be mobilized pneumatically and dispensed as desired. Scientific investigations have additionally shown that undercooled coarse sand tends to conglomerate or form clumps when moist air flows through it.

In addition, known spreading devices which are operated by an on-board compressed air network independently with compressors usually do not have "industrially dry" air. When using spreading materials which contain moisture-sensitive or even hygroscopic components, this can have the result that spreading materials tend to clump when moist compressor air flows through.

The object is therefore to provide a spreading device with which a uniform quantity of free-flowing spreading material can be continuously dispensed securely and blown reliably onto the rails in front of the wheels in which air with relatively low pressure is required for reliable blowing out or dispensing of the sand or spreading material and with which an unintentional emergence of sand or spreading material when the spreading device is not is use is largely eliminated.

SUMMARY OF THE INVENTION

This object is solved according to the invention by a spreading device for the pneumatic dispensing of a free-flowing spreading material on rail-mounted vehicles, at least consisting of a sand container with an outlet opening and a connecting pipe at the lower end of the sand container with a further outlet opening at the lower end of the connecting pipe, a mixing container substantially enclosed in an airtight manner on all sides with cover and base with inner ventilation floor and an outlet with adjoining dispensing device for the spreading material, an air source with an air line and an air inlet into the mixing container, as well as a sand staircase, wherein the sand container as storage container contains the spreading material and the spreading material can trickle as a result of weight force through the outlet opening into the connecting pipe and through the further outlet opening into the mixing container and can be deposited on the ventilation floor, wherein the outlet opening at the lower end of the connecting pipe forming the sand staircase lies lower than the outlet of the mixing container, wherein the air inlet is disposed below the ventilation floor and spreading material deposited on the ventilation floor can have air from the air source flowing through from bottom to top and mobilized spreading material can be dispensed as air-spreading material mixture through the dispensing device from the spreading device.

Expedient further development or embodiments of the invention are characterized hereinbelow.

BRIEF DESCRIPTION OF THE DRAWINGS

Preferred embodiments of the spreading device according to the invention are explained in detail hereinafter with reference to the drawings.

In the figures

DETAILED DESCRIPTION

Figure 1:
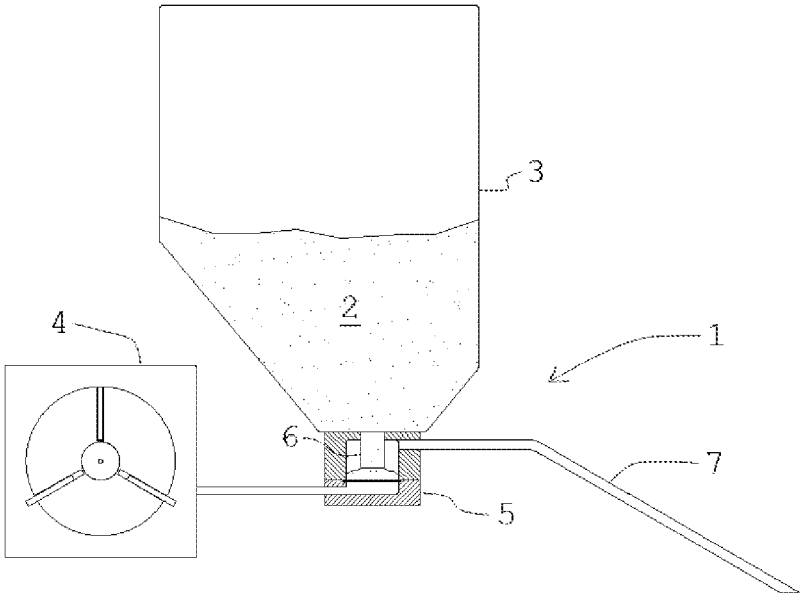
FIG. 1 shows a spreading device according to the invention in a schematic view of the arrangement and FIG. 2 shows a preferred embodiment of the mixing container of the spreading device in a schematic sectional view.
Figure 2:
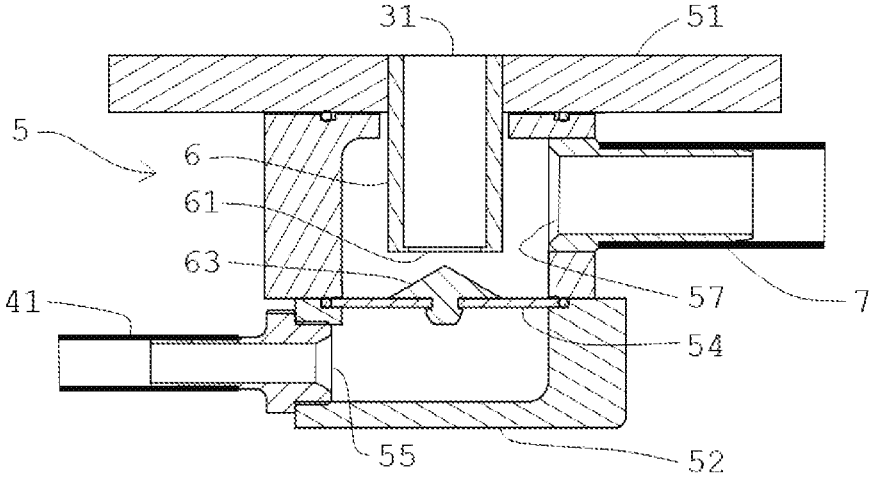

In the spreading device 1 according to the invention, an enclosed mixing container 5 is located underneath the sand container 3. A connecting pipe 6 projects from the sand container from above into the mixing container through which sand or spreading material 2 can trickle or flow from the sand container through the force of its own weight into the mixing container.

An air supply line 41 leads from an air source 4 to the air inlet 55 of the mixing container 55. In the mixing container the spreading material flowing in from the sand container is mobilized or mixed with the supplied air and the air-spreading material mixture is dispensed from an outlet 57 through a connected dispensing device 7, for example with a sanding hose or a sanding pipe, from the spreading device.

A ventilation floor 54 is provided between base 52 of the mixing container 5 and outlet opening 61 of the connecting pipe 6. The air inlet 55 is located between ventilation floor and base of the mixing container. The outlet 57 for the spreading material or air-spreading material mixture is located above the ventilation floor. In order to form a sand staircase, the outlet 57 is located above the outlet opening 61 of the connecting pipe.

The cover 51 of the mixing container can in this case advantageously form the base of the sand container 3 so that the outlet opening 31 of the sand container coincides with the upper side of the cover. The cover can in particular form a constructive unit with the connecting pipe 6 and the upper opening of the connecting pipe can coincide with the outlet opening of the sand container.

According to the invention the free-flowing spreading material trickles or flows as a result of weight force from the sand container 3 through the connecting pipe 6 into the mixing container 5. The construction of sand container 3, connecting pipe 6 and mixing container 5 thus can be pictured as an hourglass, of which it is known that the same quantity of sand per unit time always flows through the constriction between the upper and lower container and specifically independently of the fill level of the sand in the upper container. Thus, by suitably selecting the free flow cross-section of the outlet opening 61 of the connecting pipe or of the connecting pipe itself, there is also the design possibility of restricting the maximum possible flow rate of the spreading material to an upper amount which can be selected.

In order to improve the operating principle of the sand staircase, the outlet opening 61 is preferably configured to be constricted itself by providing a collar or another perforated construction with respect to the connecting pipe. In this context, use is made of the "trap door effect" known in geotechnics. In principle, the rearrangement of the effective stresses as a result of vault formation of the sand particles in the connecting pipe directly above the constricted outlet opening 61 brings about a reduction of the weight force of the spreading material in the connecting pipe 6 on the sand in the mixing container underneath the outlet opening 61. As a result, a sand staircase with very flat steps or very low height difference between outlet 57 and outlet opening 61 can be achieved, without spreading material being above to unintentionally overcome the sand staircase due to the action of shakings or vibrations.

It is advantageous to dimension the cross-sectional area of the outlet opening 61 on the one hand so that a desired maximum quantity of sand spreading is achieved but not significantly exceeded and on the other hand to select the inside diameter of cross-section of the connecting pipe to be relatively so large that vaulting effect or trap door effect can become effective but also as narrow as possible so that the spreading material particles are substantially immovable as a result of plug formation in the horizontal direction.

The ratio of length to inside diameter or to the flow cross-section of the connecting pipe is advantageously selected so that even when the sand container is almost empty, a stable sand plug with quasi-static vault effect can still form in the connecting pipe above the outlet opening 61. The advantageous formation of a sand plug or an adequate vault effect is already achieved in the intended connecting pipes having a round cross-section from a ratio of the pipe length above a constricted outlet opening to the inside diameter of about 1.0. In the case of non-round connecting pipes or connecting pipes having a non-constant inside cross-section over the pipe length the condition applies similarly relative to cross-sectional equivalent or mean diameter.

In the case of a very full sand container, even in the most unfavourable case the entire weight force of the sand column is deflected as a result of vault formation directly above the outlet opening 61 in the connecting pipe and is intercepted in the pipe structure. This means that for every fill level of the spreading material in the sand container below the outlet opening 61 substantially constant effective compressive stress ratios prevail in the spreading material and that therefore the spreading material in the mixing container 5 cannot disadvantageously compact or hold up.

Below the connecting pipe and at a distance from the outlet opening, a ventilation floor 54 is disposed in the mixing container 5. The ventilation floor preferably consists of a sintered metal plate or a grid construction and is configured in such a manner that on the one hand the spreading material can be deposited completely above the ventilation floor but air from the air inlet 55 and air impurities which may be present can pass through the ventilation floor from bottom to top.

Depending on the distance of the outlet opening 61 from the ventilation floor 54 and depending on the inside width of the mixing container, a spreading material covering having more or less uniform layer thickness and more or less heaped conical surface is formed above the ventilation floor as a result of the spreading material flowing out from the connecting pipe in the mixing container. The distance of the outlet opening 61 from the ventilation floor 54 and the clear width of the mixing container 5 are dimensioned so that the ventilation floor is almost always covered with spreading material in a defined minimum layer thickness. On the other hand, the distance between outlet opening 61 and ventilation floor 54 is preferably smaller than the inside width of the mixing container 5 so that the spreading material in the mixing container cannot hold up as a result of its own weight and any shakings or vibrations to form a plug.

In the case of shakings or vibration caused by operation and due to corresponding loosening of the spreading material layer, however, a horizontal spreading material surface is advantageously established in the mixing container 5 only a little above the outlet opening 61. The height position of the outlet 57 for the spreading material is consequently advantageously selected so that substantially no spreading material from the spreading material layer possibly moved by vibration can enter into the outlet 57.

On the other hand, in order to form a very flat sand staircase, the height position of the outlet 57 is selected to be so low that during ventilation of the spreading material layer from below and consequently due to uplift, loosening, expansion or density reduction of the spreading material layer, the surface of the spreading material layer is raised above the height level of the sand staircase. Sand particles thereby mobilized are grasped by the exhaust air flowing to the outlet 57 and tend to be moved horizontally to the outlet 57 and over the sand staircase. It is self-evident that depending on the inflowing amount of air from the air source 4, more spreading material particles or sand grains in the mixing container are swirled up and mobilized and accelerated accordingly with increasing air speed and blown out of the spreading device through outlet 57 and dispensing device 7.

In an advantageous embodiment of the spreading device, the sand container 3 is configured to be as impermeable to air as possible so that the inflowing air from the air source 4 can be used as controlled as possible and completely for mobilizing and for blowing out the spreading material or does not uncontrollably influence the preceding stationary spreading material flow due to any secondary air losses, through the connecting pipe and sand container openings.

On the other hand, if there is sufficient quantity of air available and as a result of the "hourglass effect" as described previously, the pneumatic control device is sufficiently robust in a simple manner so that due to the system a predefined upper limit on the quantity of spreading material is advantageously never exceeded.

In an additional advantageous embodiment of the spreading device, a guiding device 63 is disposed on the ventilation floor 54 in the region below the outlet opening 61. The guiding device is configured so that the spreading material flowing out from the connecting pipe is horizontally or radially deflected and consequently is deposited on the ventilation floor in the most uniform possible layer thickness.

Nevertheless, the guiding device 63 is advantageously configured so that the inflowing air from below is guided around the guiding device and consequently is not blown directly into the outlet opening 61 of the connecting pipe. On the contrary, with steady-state air flow as a result of the "Venturi effect", a reduced positive air pressure is established in the connecting pipe 6 and in the sand container 3 or at least a larger "air stagnation positive pressure" in the connecting pipe and sand container is avoided as a result of direct air irradiation of the outlet opening 61.

With a largely airtight configuration of the sand container 3, an excessive through-flow of the spreading material supply in the sand container 3 with possibly moist compressor or ambient air is therefore advantageously avoided at the same time and thus the risk of "clumping" of a sensitive spreading material is reduced.

The further dispensing of the sand-air mixture from the mixing container 5 is accomplished in a fundamentally known manner by means of thin-flow conveying technology through outlet 57 and dispensing device 7. The desired quantity of dispensed spreading material can advantageously be controlled in a fundamentally known manner by means of the dimensions of the structural components and by means of design of the pneumatic system. Thus, it is also possible with the proposed spreading device to advantageously control the desired amount of spreading material of any free-flowing spreading material by means of the dimensions of the structural components and by means of design of the pneumatic system.

In an advantageous configuration of the proposed control device, a heater which keeps the spreading material free-flowing by supplying heat is in particular additionally provided for the pneumatic dispensing of particularly moisture-sensitive spreading materials.

An arrangement of fundamentally known electrical heating elements in operative communication with the connecting pipe 6 and/or the cover 51 of the mixing container 5 is particularly effective, in particular when the cover 51 constructively advantageously forms the base of the sand container 3 or is coupled to this in a heat-conducting manner. In scientific studies it has specifically been shown that heat transfer is more effective when heated structural parts are in direct contact with the granular spreading material than by heated air flowing through the granular spreading material. With a heated connecting pipe 6, this circumstance is particularly advantageously complied with because a relatively small amount of spreading material in a compact plug form is "encased" by the connecting pipe 6 and this encasing surface forms a relatively large contact surface with the spreading material for better heat transfer.

It is also advantageous to jointly heat the structure comprising connecting pipe 6 and cover 61 of the mixing container 5 in order to achieve a larger heat store or to heat the spreading material 2 in the sand container 3, preferably in the vicinity of the outlet opening 31 of the sand container, if necessary and thus keep it free-flowing.

In order not to lose thermal energy unnecessarily, it is proposed to thermally separate the heated structural parts from the unheated ones. In particular, in an advantageous embodiment of the spreading device, a thermal insulation is provided between heated connecting pipe 6 with cover 51 and the remaining structure of the mixing container 5.

The proposed spreading device can thus advantageously also be adjusted for operation with a spreading material which can be more moisture-sensitive than coarse quartz sand in its mineral composition or by means of which operation of the spreading device is associated with more sparing consumption or with lower fine dust dispensing.

It is also economically advantageously possible with the proposed spreading device to operate this reliably with a conveying air pressure of less than 1 bar because the spreading material cannot unintentionally compact or hold up.

The invention claimed is:

1. Spreading device (1) for the pneumatic dispensing of a free-flowing spreading material (2) on rail-mounted vehicles, comprising a sand container (3) with an outlet opening (31) and a connecting pipe (6) at the lower end of the sand container with a further outlet opening (61) at the lower end of the connecting pipe, a mixing container (5) substantially enclosed in an airtight manner on all sides with cover (51) and base (52) with inner ventilation floor (54) and an outlet (57) with adjoining dispensing device (7) for the spreading material, an air source (4) with an air line (41) and an air inlet (55) into the mixing container, as well as a sand staircase, wherein the sand container as storage container contains the spreading material and the spreading material can trickle as a result of weight force through the outlet opening (31) into the connecting pipe and through the further outlet opening (61) into the mixing container and can be deposited on the ventilation floor, wherein the outlet opening (61) at the lower end of the connecting pipe forming the sand staircase lies lower than the outlet (57) of the mixing container, wherein the air inlet (55) is disposed below the ventilation floor and spreading material deposited on the ventilation floor can have air from the air source flowing through from bottom to top and mobilized spreading material (2) can be dispensed as air-spreading material mixture through the dispensing device (7) from the spreading device (1).

2. The spreading device with a connecting pipe (6) and an outlet opening (61) of the connecting pipe according to claim 1, wherein the outlet opening is configured to be constricted with respect to the pipe inner cross-section of the connecting pipe so that in the connecting pipe when the spreading device is not operating, the spreading material (2) directly above the constricted outlet opening can compact or hold up to a plug and that during pneumatic operation of the spreading device the after-trickling quantity of spreading material is restricted to a defined quantitative upper limit according to the operating principle of an hourglass.

3. The spreading device having a mixing container (5), a connecting pipe with outlet opening (61) and a ventilation floor (54) according to claim 1, wherein the vertical distance of the outlet opening (61) to the ventilation floor (54) in relation to the horizontal inside inner dimensions of the mixing container (5) is selected to be so small that the spreading material deposited on the ventilation floor in corresponding layer thickness cannot hold up or compact to a plug as a result of the spreading material's own weight or vibrations.

4. The spreading device having a sand container (3), a connecting pipe (6), a mixing container (5) and a heat source according to claim 1, wherein the cover (51) of the mixing container, the base of the sand container and the connecting pipe are in thermally conductive operative communication and can be heated by the heat source.

5. The spreading device according to claim 4, wherein the cover (51) of the mixing container, the base of the sand container and the connecting pipe are thermally insulated against all the other structural parts of the spreading device in such a manner that substantially no undesired release of heat to the other structural parts is brought about.

6. The spreading device with an outlet opening (61) of the connecting pipe (6) and a ventilation floor (54) according to claim 1, wherein a guiding device (63) is disposed on the ventilation floor in such a manner that the air flowing through the spreading material is guided around the outlet opening (61) or at least does not directly irradiate the outlet opening.

7. The spreading device with an air source (4) according to claim 1, wherein the air source is configured as an air pump generating a maximum 1 bar air pressure.

* * * * *